US007660552B2

(12) United States Patent
Yamagata

(10) Patent No.: US 7,660,552 B2
(45) Date of Patent: Feb. 9, 2010

(54) IMAGE FORMING APPARATUS AND TEST PATTERN

(75) Inventor: Kazuhiro Yamagata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 221 days.

(21) Appl. No.: 11/780,785

(22) Filed: Jul. 20, 2007

(65) Prior Publication Data

US 2008/0019724 A1 Jan. 24, 2008

(30) Foreign Application Priority Data

Jul. 20, 2006 (JP) ..... 2006-198499

(51) Int. Cl.
*G03G 15/01* (2006.01)

(52) U.S. Cl. ..... 399/301

(58) Field of Classification Search ..... 399/301; 347/116, 254

See application file for complete search history.

(56) References Cited

U.S. PATENT DOCUMENTS

| | | | |
|---|---|---|---|
| 5,854,958 | A | 12/1998 | Tanimoto et al. |
| 7,039,348 | B2 | 5/2006 | Kerxhalli et al. |
| 2005/0083530 | A1 | 4/2005 | Ogihara et al. |
| 2005/0212887 | A1 | 9/2005 | Tanaka et al. |

FOREIGN PATENT DOCUMENTS

| | | | |
|---|---|---|---|
| JP | 8278680 | | 10/1996 |
| JP | 11084978 | | 3/1999 |
| JP | 2001201896 | A | 7/2001 |
| JP | 2002023450 | A | 1/2002 |
| JP | 2003114551 | | 4/2003 |
| JP | 2003205645 | A | 7/2003 |
| JP | 2004098593 | A | 4/2004 |
| JP | 2004199069 | | 7/2004 |
| JP | 2004-333837 | A | 11/2004 |
| JP | 2006106554 | A | 4/2006 |

OTHER PUBLICATIONS

Extended EP Search Report Dec. 3, 2007, EP Appln. 07252879.7-2209.

JP Office Action dtd Jun. 3, 2008, JP Appln. 2006-198499, partial English Translation provided.

*Primary Examiner*—David M Gray
*Assistant Examiner*—Rodney Bonnette
(74) *Attorney, Agent, or Firm*—Banner & Witcoff, Ltd.

(57) ABSTRACT

An image forming apparatus includes a conveying unit that conveys a transferred medium in a first direction, an image forming unit, a controller that controls the image forming unit to form a test pattern including first and second line segments slanting toward directions opposite to each other, wherein the first line segment is offset, in an offset direction, from a second direction orthogonal to the first direction and the second line segment is offset, in a direction opposite to the offset direction, from the second direction, a detection unit that detects passage of at least respective parts of the first and second line segments; and a calculating unit that calculates a position where the image forming unit forms an image based on a time difference between times at which the detection unit detects the passage of the at least part of the first and second line segments.

14 Claims, 12 Drawing Sheets

IMAGE FORMING APPARATUS AND TEST PATTERN

CROSS-REFERENCE TO RELATED APPLICATION

This application claims priority from Japanese Patent Application No. 2006-198499, filed on Jul. 20, 2006, the entire subject matter of which is incorporated herein by reference.

TECHNICAL FIELD

Aspects of the present invention relate to an image forming apparatus which forms an image on a transferred medium, and more specifically, to an image forming apparatus which can calculate image forming positions by detecting test patterns by forming the test patterns on the transferred medium or a transferred medium conveying unit that conveys the transferred medium.

BACKGROUND

An image forming apparatus includes an image forming unit that forms images on a transferred medium such as a sheet conveyed on a transferred medium conveying unit such as a belt. In this type of image forming apparatus, positional deviations of images formed on the transferred medium by the image forming unit may become a factor. Particularly, in a color image forming apparatus, if the positions of images in colors of cyan, yellow, and magenta or the like deviate, it appears as so-called color shift and a clear image cannot be formed.

Therefore, it has been proposed that test patterns (also called registration marks) are formed on the transferred medium conveying unit or the transferred medium and passage timings of the test patterns are optically detected by detection sensors to calculate the positions of the images (See, e.g. JP-A-8-278680).

In JP-A-8-278680, on a belt as the transferred medium conveying unit, as illustrated in FIG. 8A, a test pattern TP consisting of a line segment L1 orthogonal to the moving direction of the belt and a line segment L2 slanting with respect to the moving direction is formed. Based on a detection timing difference between the line segments L1 and L2, the positions in a main scanning direction (orthogonal to the moving direction) of the test patterns TP can be detected.

However, if a spot diameter of the detection sensor is in a circle shown by SS in FIG. 8A where the spot diameter is larger than the widths of the line segments L1 and L2, the height of a peak differs between the detection of the line segment L1 and the detection of the line segment L2 in the detection sensor output waveform as shown in FIG. 8B. In this case, a threshold Sh to be used for detection of the line segments L1 and L2 has to be set to a narrow range according to the lower peak height as shown by an arrow in FIG. 8B, so that the detection stability does not deteriorate.

If the spot diameter SS is narrowed by using a slit plate, the height of the peak can be made equal between the detection of the line segment L1 and the detection of the line segment L2, however, the number of parts increases and the manufacturing cost increases. If the spot diameter SS is narrowed, the peak of the output waveform also accordingly is reduced. As a result, there is a possibility that the stability of the detection cannot be greatly improved.

SUMMARY

An aspect of the present invention provides an image forming apparatus including: a conveying unit that conveys a transferred medium in a first direction; an image forming unit that forms an image on the transferred medium conveyed by the conveying unit; a controller that controls the image forming unit to form a test pattern on either one of the conveying unit and the transferred medium, the test pattern including first and second line segments slanting toward directions opposite to each other, wherein the first line segment is offset, in an offset direction, from a second direction orthogonal to the first direction and the second line segment is offset, in a direction opposite to the offset direction, from the second direction; a detection unit that is disposed downstream from the image forming unit in the first direction and detects passage of at least respective parts of the first and second line segments; and a calculating unit that calculates a position where the image forming unit forms an image based on a time difference between times at which the detection unit detects the passage of the at least respective parts of the first and second line segments.

The first and second line segments in the test pattern formed as described above slant toward direction opposite to each other from the second direction, that is, the width direction, so that passage of the first and second line segments can be detected similarly by the detection unit. Therefore, the threshold settable range for detection can be widened, and the first and second line segments can be stably detected without an increase in the number of parts. In addition, the first and second line segments slant toward directions opposite to each other from the second direction so that a position of an image that the image forming unit forms can be satisfactorily calculated based on a difference in times at which the detection unit detects passage of the first and second line segments.

DETAILED DESCRIPTION

Hereinafter, aspects of the present invention will be described with reference to the drawings.

Figure 1:
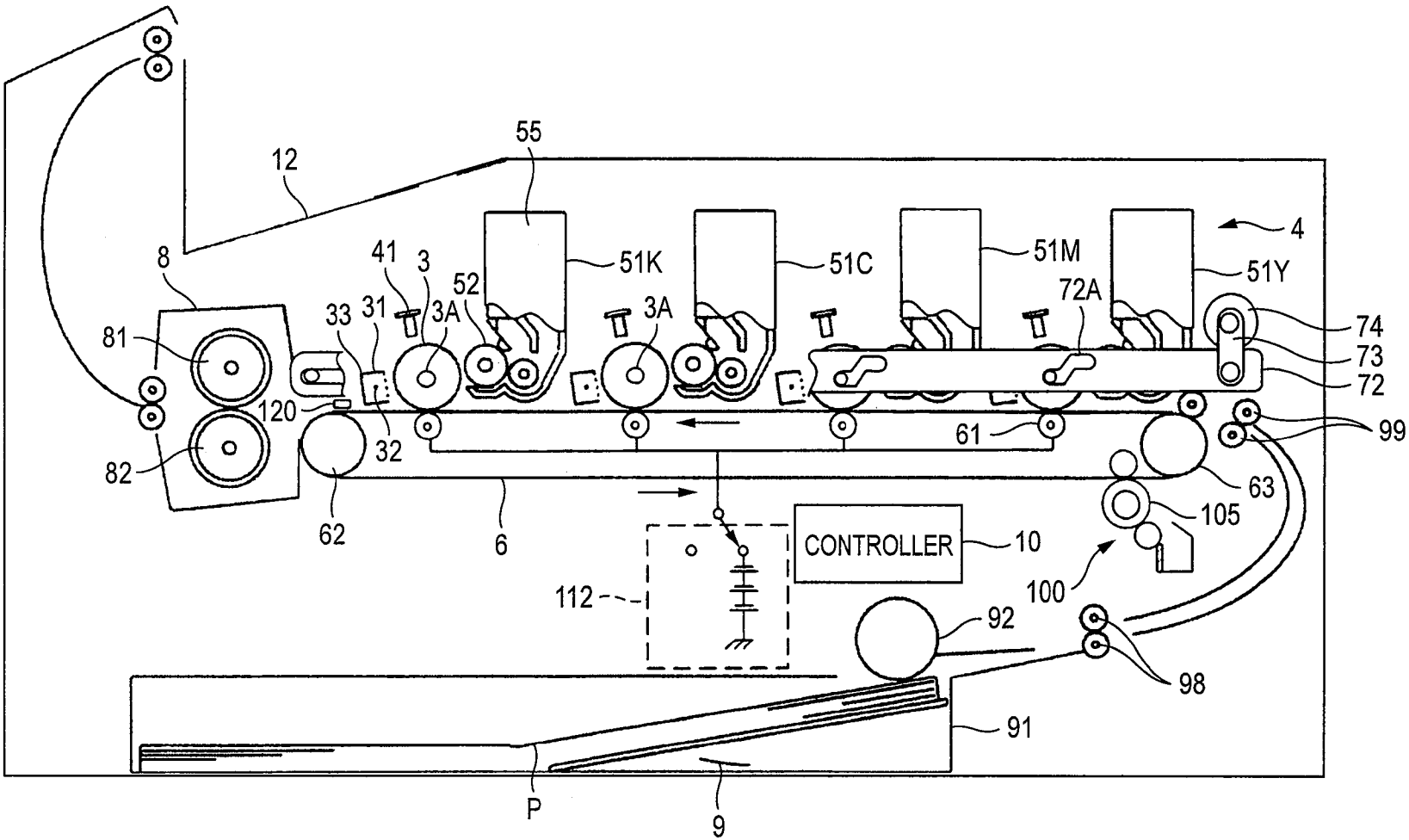
FIG. 1 is a schematic sectional view showing an internal configuration of a color laser printer according to an aspect of the invention.

FIG. 1 is a schematic sectional view of an internal configuration of a color laser printer (hereinafter, referred to as simply a printer) serves as an image forming apparatus according to an aspect of the present invention.

[Entire Configuration of Printer]

The printer 1 illustrated in FIG. 1 includes a toner image forming unit 4, a sheet conveying belt 6 serves as a conveying unit, a fixing device 8, a sheet feeder 9, a stacker 12, and a controller 10, and forms an image in four colors according to an image data inputted from the outside.

The toner image forming unit 4 includes four developing units 51Y, 51M, 51C, and 51K. For each of four toner forming processes for yellow, magenta, cyan, and black toners T (corresponding to developer, see FIG. 2) stored in these developing units 51Y, 51M, 51C, and 51K, the toner image forming unit 4 further includes a photoconductor drum 3 serving as a photoconductor, a charger 31 for evenly charging the photoconductor drum 3, and a scanner unit 41 serving as an exposing unit for forming an electrostatic latent image according to image data by exposing by a laser beam the surface of the photoconductor drum 3 after being changed. The majority of the scanner unit 41 is not shown in the drawing, and only the portion from which a laser beam is finally outputted is shown.

Hereinafter, configurations of each component will be described in detail. In the following description, when a component is necessary to be distinguished by color, the reference numerals of the component are attached with Y (yellow), M (magenta), C (cyan), and K (black), and components unnecessary to be distinguished are not attached with these indicators.

The photoconductor drums 3 of the toner image forming unit 4 are formed of substantially cylindrical members, and four drums are arranged at almost equal intervals horizontally and each are disposed rotatably. Each of the substantially cylindrical members of the photoconductor drums 3 includes, for example, a positive chargeable photosensitive layer formed on aluminum-made base material. The aluminum-made base material is grounded to a ground line of the printer 1.

The charger 31 is a so-called scorotron type charger and faces the photoconductor drum 3. The charger 31 includes a charging wire 32 extending in its width direction and a shield case 33 which houses this charging wire 32 and opens at the opening portion at a side of photoconductor drum 3. The surface of the photoconductor drum 3 is charged to be positive (for example, +700V) by applying a high voltage to the charging wire 32. The shield case 33 includes a grid at the opening portion at a side of the photoconductor drum 3. The surface of the photoconductor drum 3 is charged to substantially the same potential as the grid voltage by applying a regulated voltage to this grid.

The scanner unit 41 is arranged downstream from the charger 31 in the rotating direction of each photoconductor drum 3. The scanner unit 41 emits a laser beam corresponding to one color of image data inputted from the outside from a light source and scans the laser beam by using a surface of a polygon mirror rotated by a polygon motor and irradiates the laser beam onto the surface of the photoconductor drum 3.

When the laser beam corresponding to image data is irradiated onto the surface of the photoconductor drum 3 by the scanner unit 41, a surface potential of the irradiated portion lowers (+150 to +200 V), whereby an electrostatic latent image is formed on the surface of the photoconductor drum 3.

In addition, each of the developing units 51Y, 51M, 51C, and 51K includes a developing unit case 55 for containing toners T of respective colors and a developing roller 52 serving as a developing unit therein. Each of the developing units 51Y, 51M, 51C and 51K is disposed so that the developing roller 52 comes into contact with the photoconductor drum 3 at downstream side from the scanner unit 41 in the rotating direction of the photoconductor drum 3. Each developing unit 51 charges the toner T to "+" (positive polarity) and supplies the toner T to the photoconductor drum 3 to be an even thin layer. At the contact portion between the developing roller 52 and the photoconductor drum 3, the toner T charged to "+" (positive) is carried by means of reversal development on the "+" (positive) electrostatic latent image formed on the photoconductor drum 3 and the electrostatic latent image is developed.

The developing roller 52 has a cylinder shape using conductive silicone rubber as a base material thereof. The developing roller 52 includes a coating layer of a resin containing fluorine or rubber material on the surface thereof. The toner T to be contained in the developing unit case 55 is a positively chargeable non-magnetic one component toner. Yellow, magenta, cyan, or black toner T are contained in respective developing unit case 55 according to the developing unit 51Y, 51M, 51C, or 51K.

The sheet feeder 9 is provided at the lowest portion of the printer, and includes a containing tray 91 for containing sheet P and a feed roller 92 for feeding the sheet P. The sheets P contained in the containing tray 91 are fed from the sheet feeder 9 one by one by the feed roller 92, and fed to the sheet conveying belt 6 via the conveying roller 92 and the resist rollers 99.

The sheet conveying belt 6 is configured as an endless belt and is narrower than the photoconductor drum 3 in width. The sheet conveying belt 6 travels together with the sheet P while carrying the sheet P on the upper surface thereof, and is laid across a drive roller 62 and a driven roller 63. Transfer rollers 61 are provided close to positions facing the respective photoconductor drums 3 while sandwiching the sheet conveying belt 6, respectively. The surface on the side facing the photoconductor drums 3 of the sheet conveying belt 6 moves from right to left in FIG. 1 according to the rotation of the drive roller 62 to convey the sheet P fed from the resist rollers 99 through the positions between the belt and the photoconductor drums 3 in order to the fixing device 8.

A cleaning roller 105 as an example of a cleaning mechanism is provided close to the driven roller 63 on the surface turned-back from the drive roller 62 of the sheet conveying belt 6, that is, the under-side of the belt 6. Furthermore, a detection sensor 120 as an example of the detection unit is provided at a position facing the sheet conveying belt 6 close to the drive roller 62. The configuration of this detection sensor 120 will be described in detail later.

Figure 2:
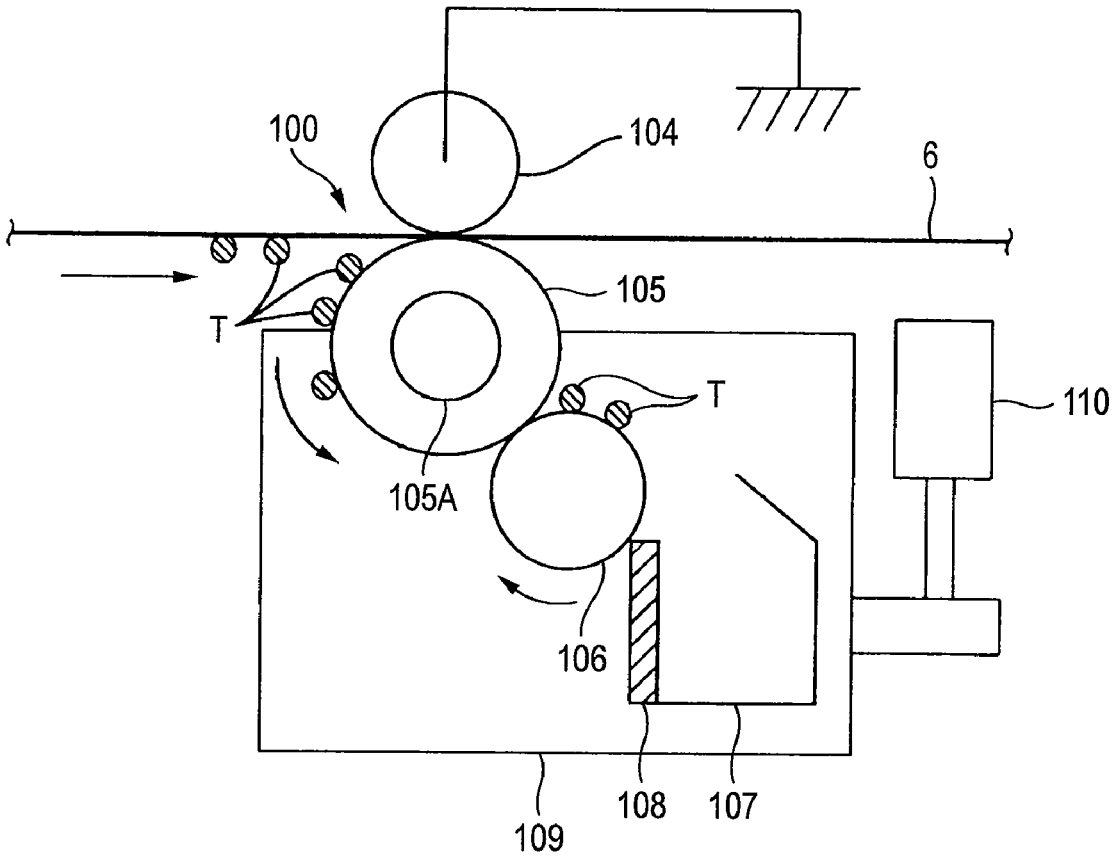
FIG. 2 is an explanatory view showing the details of the configuration of a belt cleaner of the printer.

FIG. 2 is an explanatory view showing in detail the configuration of a belt cleaner 100 including the cleaning roller 105. As shown in FIG. 2, the cleaning roller 105 is provided with a foamed material made of silicone around a shaft member 105A extending in the width direction of the sheet conveying belt 6. The cleaning roller 105 is disposed so as to rotate while being in contact with the sheet conveying belt 6 in a state where a predetermined bias is applied between the cleaning roller 105 and a metal-made electrode roller 104 provided at an opposite position across the sheet conveying belt 6. Toner T adhering to the sheet conveying belt 6 is removed by the cleaning roller 105 due to this bias. For example, the electrode roller 104 is connected to a ground line to be grounded and a bias with polarity (for example, −1200V) opposite to that of the toner T is applied to the cleaning roller 105, whereby the toner T can be vacuumed to the cleaning roller 105 and removed. The cleaning roller 105 is driven so that a rotating direction of the cleaning roller 105 and a moving direction of the sheet conveying belt become opposite at a contact portion therebetween.

The cleaning roller 105 includes a metal-made (for example, an iron material plated with Ni or a stainless steel material) collecting roller 106 for removing toner T adhering to the cleaning roller 105 therefrom and a reservoir box (reservoir container) 107 for reserving toner T removed from the cleaning roller 105. The collecting roller 106 is in contact with a rubber-made cleaning blade 108, and this cleaning blade 108 functions to scrape off the toner T adhering to the collecting roller 106.

The configuration from the cleaning roller 105 to the reservoir box 107 is housed in a casing 109, and this casing 109 is movable vertically by a belt-cleaner separating solenoid 110. Therefore, when the belt-cleaner separating solenoid 110 is made to contract to raise the casing 109, the cleaning roller 105 comes into contact with the sheet conveying belt 6. On the other hand, when the belt-cleaner separating solenoid 110 is made to expand to lower the casing 109, the cleaning roller 105 is separated from the sheet conveying belt 6.

Referring to FIG. 1, when a transfer bias (for example, −10 to −15 μA) with polarity opposite to the charged polarity of the toner T is applied between the transfer rollers 61 and the photoconductor drums 3 by a negative-voltage current source 112, the transfer rollers 61 transfer toner images formed on the photoconductor drums 3 onto the sheet P conveyed by the sheet conveying belt 6.

The fixing device 8 includes a heating roller 81 and a pressurizing roller 82, and fixes toner images onto the sheet P by heating and pressurizing the sheet P onto which toner images were transferred while sandwiching the sheet P by the heating roller 81 and the pressurizing roller 82.

On the upper surface of the printer 1, a stacker 12 is provided. This stacker 12 is provided on the sheet ejection side of the fixing device 8, and receives sheets P ejected from the fixing device 8. The controller 10 is constituted by a control device using a generally known CPU 11 (see FIG. 3) as described later, and controls the whole operation of the printer 1.

The four photoconductor drums 3 are held movably upward so as to separate from the sheet conveying belt 6, and are positioned by a moving member 72 serving as a separating unit provided across the four photoconductor drums 3. The moving member 72 is made of a plate member with a length across the four photoconductor drums 3, and is held movably horizontally in FIG. 1. The moving member 72 includes four substantially crank-shaped guide holes 72A extending horizontally. In these guide holes 72A, shafts 3A provided on the side surfaces in the longitudinal direction of the photoconductor drums 3 are fitted, respectively.

The moving member 72 is provided with a lifting motor 74 via a link 73 which converts a rotating force into a lateral force. The moving member 72 moves to the right or left according to rotation of the lifting motor 74 in response to an instruction signal from the controller 10. Thus, when the guide holes 72A move to the left while the moving member 72 moves to the left, the shafts 3A of the photoconductor drums 3 move upward along the substantially crank-shaped the guide holes 72A so that the photoconductor drums 3 are separated from the sheet conveying belt 6. To the contrary, when the moving member 72 is at the right position, the photoconductor drums 3 come into contact with the sheet conveying belt 6. Normally, image forming is performed in a state that the photoconductor drums 3 are in contact with the sheet conveying belt 6.

An operation for forming images on the sheet P in the printer 1 according to this aspect configured as described above is as follows. First, one sheet P is supplied by the feed roller 92 from the sheet feeder 9, and is fed to the sheet conveying belt 6 via the conveying rollers 98 and the resist rollers 99. Next, the surface of the rightmost photoconductor drum 3Y in FIG. 1 is evenly charged by the charger 31 and exposed corresponding to image data for yellow inputted from the outside by the scanner unit 41, and an electrostatic latent image is formed thereon as described above. Next, yellow toner T positively charged in the developing unit 51Y is supplied to the surface of this photoconductor drum 3Y and development is performed. Then, a toner image thus formed is transferred onto the surface of the sheet P conveyed by the sheet conveying belt 6 by the transfer roller 61 to which a transfer bias is applied.

Next, the sheet P is conveyed to positions facing the photoconductor drums 3 for magenta, cyan, and black in order, and toner images are formed on the surfaces of the photoconductor drums 3 through similar procedures as those for the yellow toner T and transferred onto the sheet P in an overlapping manner by the transfer roller 61. Lastly, the four-color toner image formed on the sheet P is fixed onto the sheet P by the fixing device 8 and ejected onto the stacker 12.

[Control System and Pattern Detection Processing]

In the printer 1, at the time of so-called initializing when a power is turned on or after jamming treatment, test patterns TP (see FIG. 4) are formed by using four color toners on the sheet conveying belt 6 and processing for detecting the test pattern TP forming states by the detection sensors 120 is performed. This processing will be described in detail below.

Figure 3:
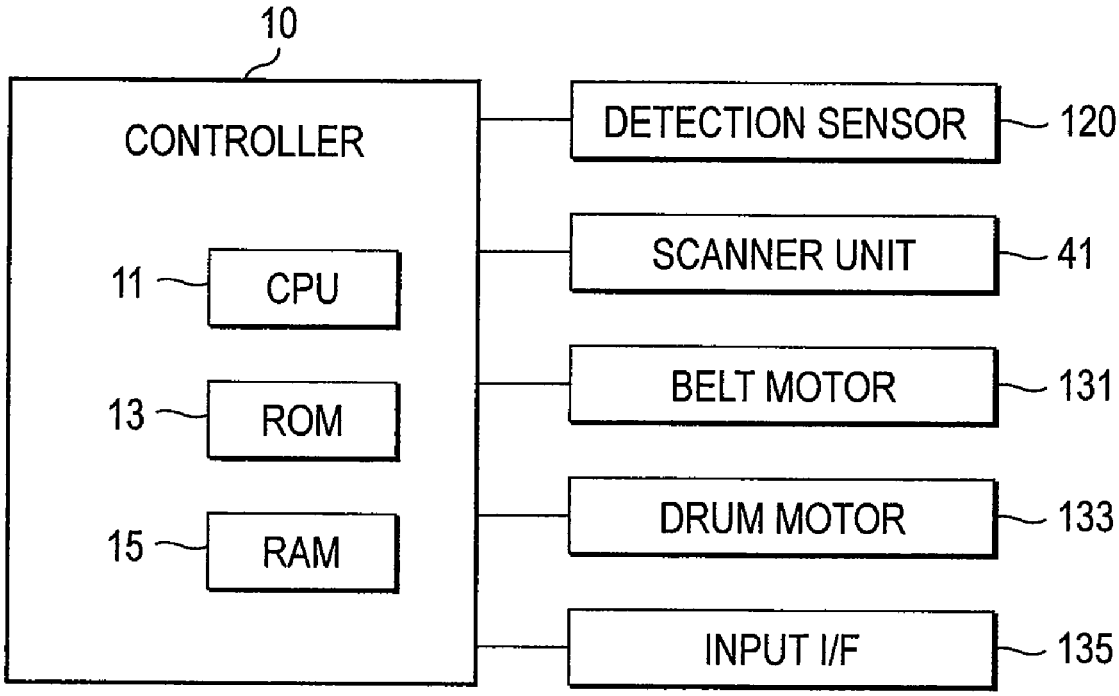
FIG. 3 is a block diagram showing a configuration of a control system of the printer.

FIG. 3 is a block diagram showing a configuration of the control system of the printer 1. The controller 10 is configured as a microcomputer mainly including a CPU 11, a ROM 13, and a RAM 15. Into this controller 10, a detection signal of the detection sensor 120 is inputted. The controller 10 outputs through drive circuits (not shown) a drive signal for the scanner unit 41, a drive signal for a belt motor 131 for driving the sheet conveying belt 6 via the drive roller 62, and a drive signal for a drum motor 133 for driving the toner image forming unit 4 including the four photoconductor drums 3. Furthermore, an input interface (input I/F) 135 into which image data is inputted from a personal computer (hereinafter, referred to as PC) or the like as a higher-order device is also connected to the controller 10.

Figure 4:
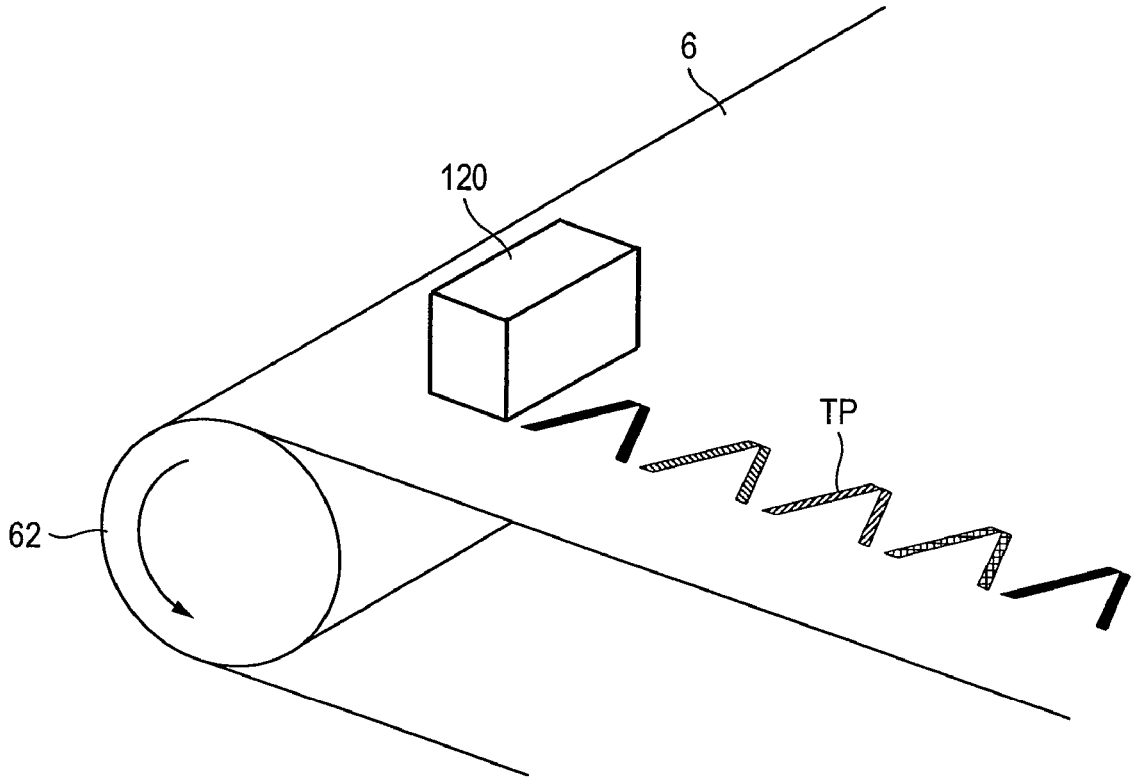
FIG. 4 is a perspective view generally showing an appearance of a detection sensor of the printer.
Figure 5:
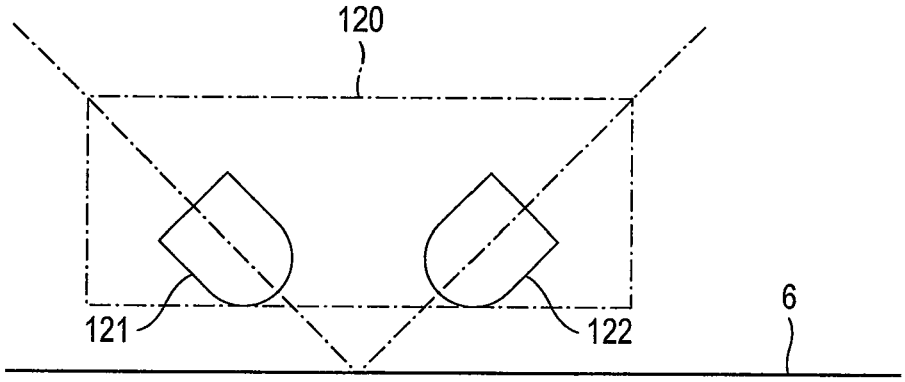
FIG. 5 is a general sectional view showing an internal configuration of the detection sensor.

As shown in FIG. 4, the detection sensor 120 is provided at each of positions opposite to both side edges in the width direction of the upper surface of the sheet conveying belt 6 close to the drive roller 62 (only one detection sensor 120 is shown in FIG. 4). As shown in FIG. 5, the detection sensor 120 includes an emitting diode 121 and a photo transistor 122, both of which are bare and oriented downward (sheet conveying belt 6 side). That is, in a path (see the alternate long and short dashed line of FIG. 5) of light which is emitted from the emitting diode 121, reflected by the sheet conveying belt 6, and reaches the phototransistor 122, any optical member such as a lens or slit is not arranged.

Figure 6:
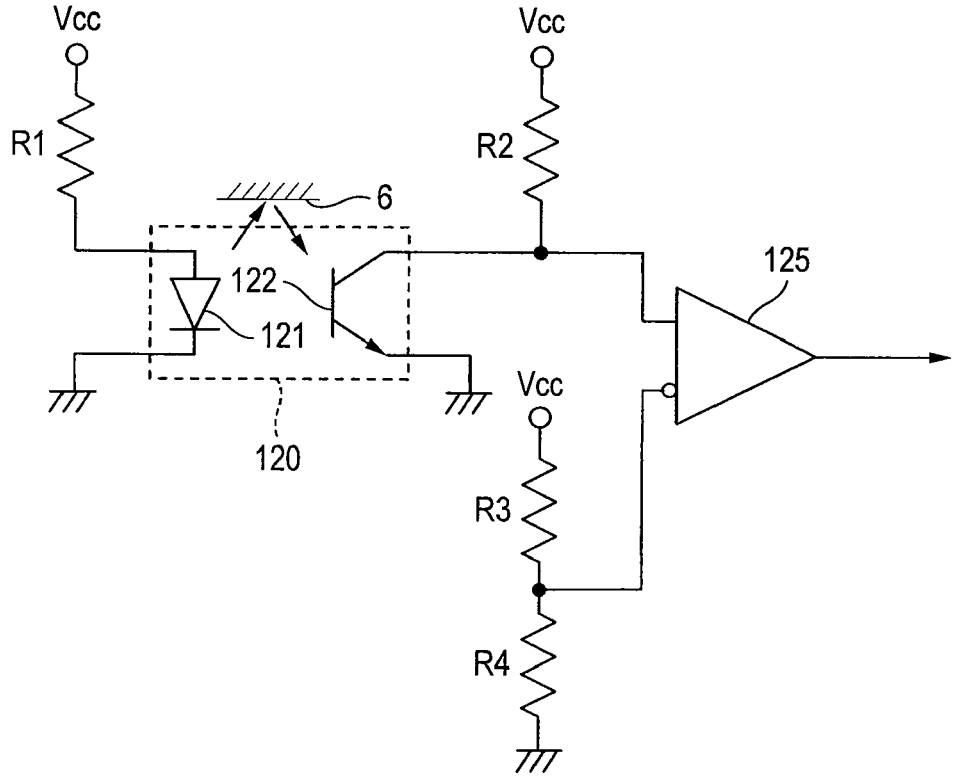
FIG. 6 is an explanatory view showing circuitry related to the detection sensor.

FIG. 6 is an explanatory view showing circuitry related to the detection sensor 120. As shown in FIG. 6, a power voltage Vcc is applied to the emitting diode 121 via a resistor R1, and accordingly, the emitting diode 121 emits light. Light emitted from the emitting diode 121 is reflected by the sheet conveying belt 6 and reaches the phototransistor 122, and according to amount of light, a current flowing in the phototransistor 122 changes.

The phototransistor 122 is connected to the power voltage Vcc via a resistor R2. A power voltage Vcc divided by this resistor R2 and the phototransistor 122 (hereinafter, this divided voltage value will also be referred to as a sensor output) is inputted into a comparator 125 together with a voltage as a threshold Sh obtained by dividing the power voltage Vcc by resistors R3 and R4. An output of this comparator 125 is inputted as a detection signal of the detection sensor 120 into the controller 10 (see FIG. 3).

That is, when light of the emitting diode 121 is reflected by a surface to which no toner adheres of the sheet conveying belt 6, the sensor output becomes low and the comparator 125 outputs a low-level signal into the controller 10. When the light is reflected by a surface to which toner adheres of the sheet conveying belt 6, the sensor output rises and the comparator 125 outputs a high-level signal into the controller 10.

Figure 7:
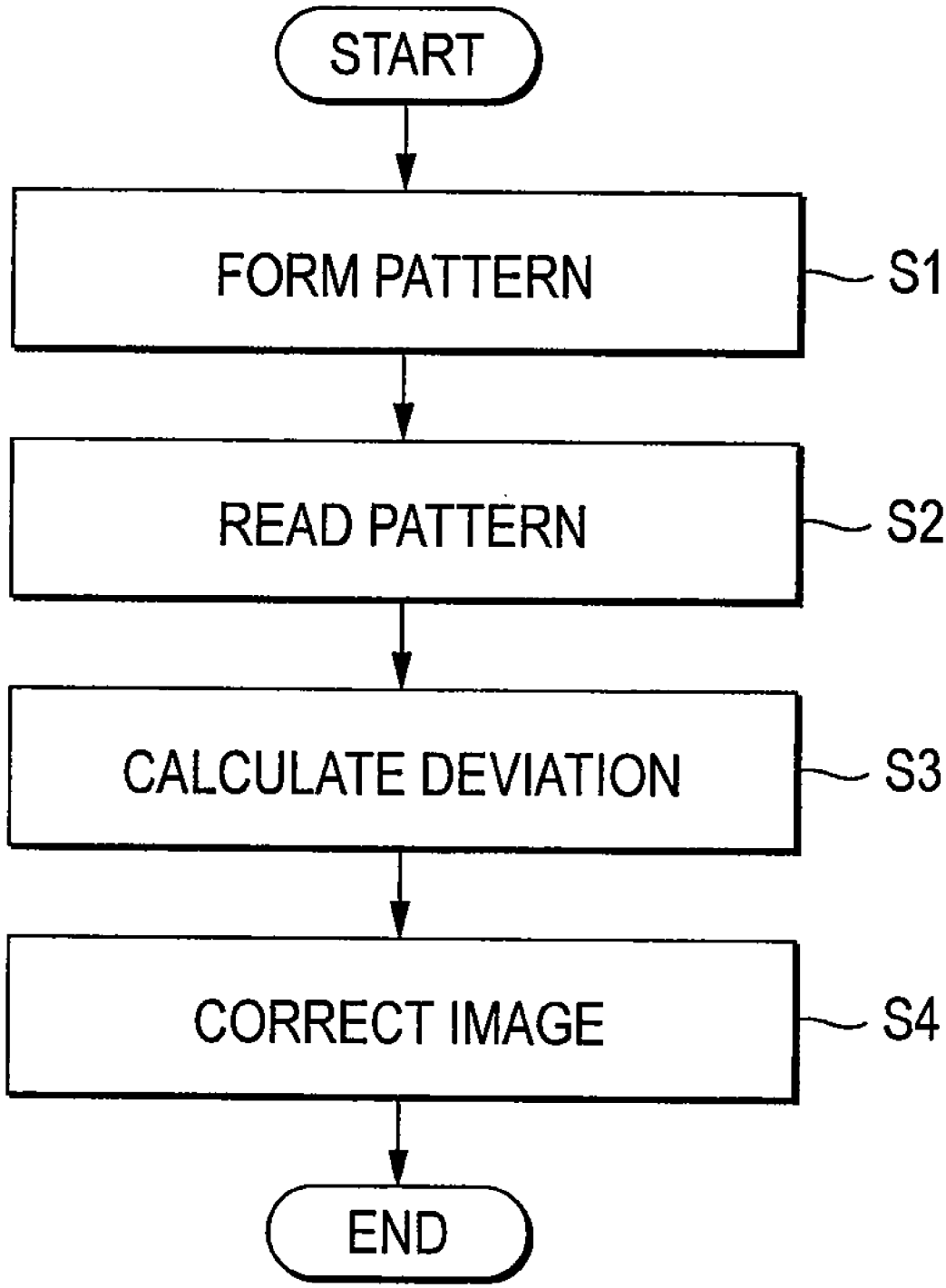
FIG. 7 is a flowchart showing color shift correcting processing to be executed in the control system.

FIG. 7 is a flowchart showing color shift correcting processing to be executed by the CPU 11 based on a program stored in the ROM 13. This processing is executed at the time of the initialization.

Figure 8A:
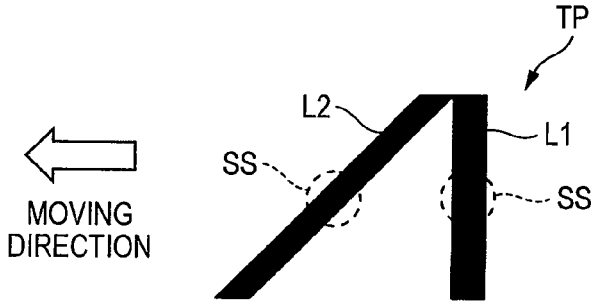
FIGS. 8A through 8D are explanatory views showing test patterns and sensor output waveforms according to the processing by comparison with a conventional example.
Figure 8C:
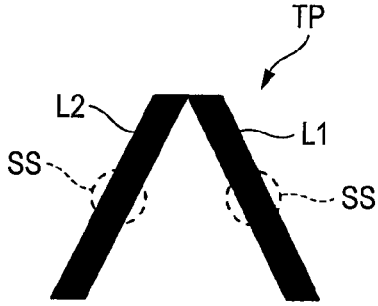
Figure 8B:
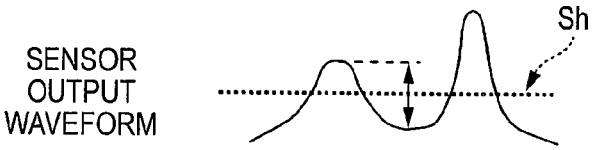

When the processing is started, first, at S1 (S indicates Step: the same applies to the following description), the belt motor 131 and the drum motor 133 are driven and test patterns TP are formed on both edges of the sheet conveying belt 6. The test pattern TP formed herein includes a pair of line segments L1 and L2 (first and second line segments) slanting toward directions opposite to each other across a straight line orthogonal to a moving direction of the sheet conveying belt 6 as shown in FIG. 8C. In other words, the line segment L1 is offset, in an offset direction, from the main scanning direction and the line segment L2 is offset, in a direction opposite to the offset direction, from the main scanning direction. The test patterns TP are successively formed in single colors in order of black, cyan, magenta, and yellow (see FIG. 10).

Figure 8D:
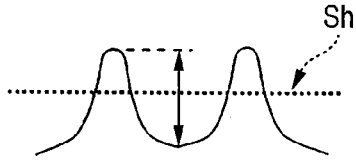

Next, at S2, the test patterns TP are conveyed to the position facing the detection sensor 120 by further driving of the belt motor 131, and the test patterns TP are read. That is, when the test pattern TP moves to the position facing the detection sensor 120, the sensor output changes as illustrated in FIG. 8D, and a corresponding output of the comparator 125 is inputted into the controller 10. At S2, this comparator output is read.

At S3, based on the comparator outputs read at S2, relative deviations of the test patterns TP are calculated, and processing for correcting the deviations is performed. Then, this color shift correcting processing is ended.

Figure 9:
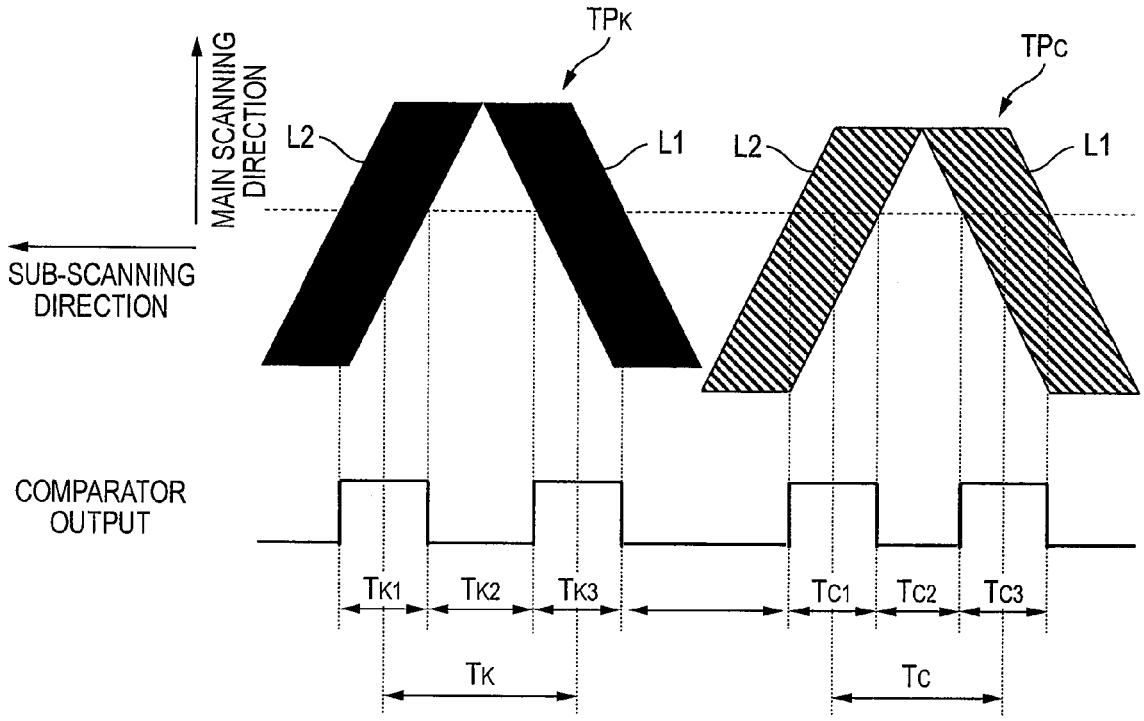
FIG. 9 is an explanatory view showing a color shift amount calculating method according to the processing.

Subsequently, the processing of S3 and S4 will be described in detail. When it is assumed that the position of regular reflection of light emitted from the emitting diode 121 toward the phototransistor 122 passes through the position shown by the dotted line in FIG. 9, the output of the comparator 125 changes as shown in FIG. 9. That is, when the detection sensor 120 faces the line segments L1 and L2 constituting the test pattern TP, the comparator output becomes high. Peaks of this comparator output have peak widths corresponding to the widths in the sub-scanning direction (that is, the moving direction of the sheet conveying belt 6) of the line segments L1 and L2. When the interval between the peaks detected for the line segments L1 and L2 of each color test pattern TP is defined as an interval between the middle points of the peaks, the peak intervals $T_K$ and $T_C$ according to the test patterns $TP_K$ and $TP_C$ in black and cyan illustrated in FIG. 9 are expressed by the following equations (1).

$$T_k = \frac{1}{2}T_{k1} + T_{k2} + \frac{1}{2}T_{k3} \qquad (1)$$

$$T_c = \frac{1}{2}T_{c1} + T_{c2} + \frac{1}{2}T_{c3}$$

In these equations, $T_{K1}$ denotes a peak width of line segment L2 detected first when the sensor faces the black test pattern $TP_K$, $T_{K2}$ denotes an interval from the drop of the peak of the line segment L2 to the rise of the peak of the line segment L1, and $T_{K3}$ denotes a peak width of the line segment L1 detected later. Similarly, $T_{C1}$ denotes a peak width of the line segment L2 detected first when the sensor faces the cyan test pattern $TP_C$, $T_{C2}$ denotes an interval from the drop of the peak of the line segment L2 to the rise of the peak of the line segment L1, and $TC_3$ denotes a peak width of the line segment L1 detected later.

From these peak intervals $T_K$ and $T_C$ and the time $T_{line}$ corresponding to movement by one line in the sub-scanning direction of the sheet conveying belt 6, a relative deviation $D_{KC}$ between the black test pattern $TP_K$ and the cyan test pattern $TP_C$ can be calculated by the following equation (2).

$$D_{kc} = \frac{T_c - T_k}{T_{line}} \qquad (2)$$

Figure 10:
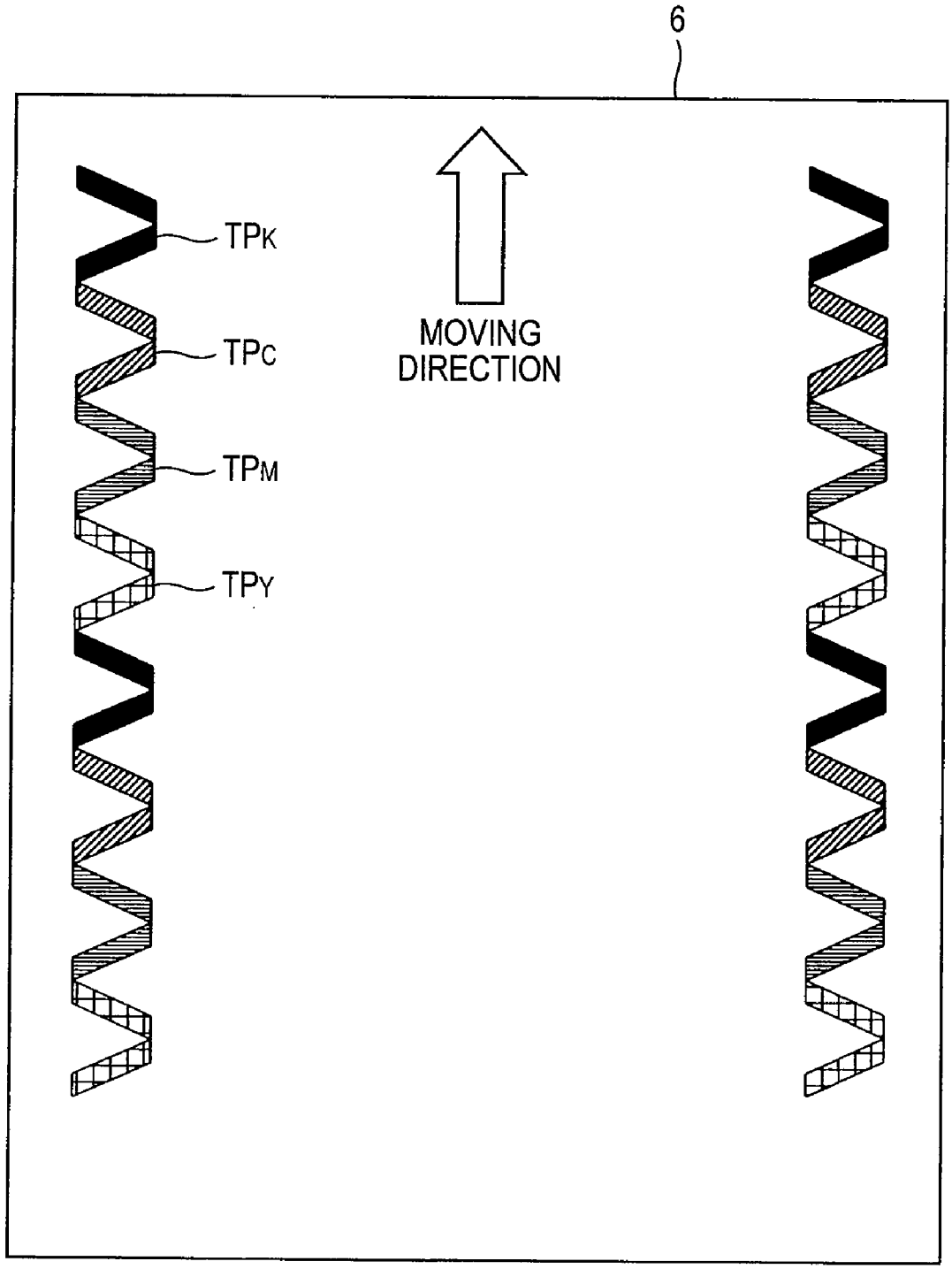
FIG. 10 is an explanatory view showing the entire configuration of the test patterns according to the processing.

In this equation, as illustrated in FIG. 9 and FIG. 10, when the line segments L1 and L2 of each test pattern TP open to the left with respect to the moving direction of the sheet conveying belt 6, the deviation $D_{KC}$ becomes greater as the test pattern $TP_C$ deviates more to the right with respect to the test pattern $TP_K$. As illustrated in FIG. 10, each test pattern $TP_K$ through $TP_Y$ is formed on both left and right sides of the sheet conveying belt 6, so that the deviation $D_{KCR}$ with respect to the right side test patterns $TP_K$ and $TP_C$ in the moving direction of the sheet conveying belt 6 and the deviation $D_{KCL}$ with respect to the left side test patterns $TP_K$ and $TP_C$ are calculated individually. Furthermore, between cyan and magenta and between magenta and yellow, deviations $D_{CMR}$, $D_{CML}$, $D_{MYR}$, and $D_{MYL}$ are also calculated similarly.

In addition, as shown in the example of FIG. 10, when the test patterns $TP_K$ through $TP_Y$ are formed a plurality of times repeatedly (two times in the example of FIG. 10), averages of deviations $D_{KCR}$, $D_{KCL}$, $D_{CMR}$, $D_{CML}$, $D_{MYR}$, and $D_{MYL}$ are calculated with respect to the respective test patterns $TP_K$ through $TP_Y$. Thereby, influences from flaws and wrinkles of the sheet conveying belt 6 can be reduced.

At S4, the following correction is made by using the calculated deviations $D_{KCR}$, $D_{KCL}$, $D_{CMR}$, $D_{CML}$, $D_{MYR}$, and $D_{MYL}$. First, the writing start positions of the images in the respective colors are corrected based on deviations on the scanning origin side. For example, scanning by a polygon mirror is performed from the left side with respect to the moving direction of the sheet conveying belt 6, the image writing start timings are corrected by using the calculated deviations $D_{KCL}$, $D_{CML}$, and $D_{MYL}$. For example, the deviation difference $D_{KCR}-D_{KCL}$ between the left and right indicates a width difference in the scanning direction between the black image and the cyan image. Therefore, this deviation difference between the left and right is corrected according to a color whose image width is smallest by thinning-out dots of image data of other colors. For example, it is assumed that a toner image forming unit 4 is capable of forming an image of 10000 dots in the width direction. If $D_{KCR}-D_{KCL}$ is two dots, image data of arbitrary two dots such as the image data of the first dot and the image data of the 5001st dot in the image data of cyan are thinned-out, whereby the black image and the cyan image can be matched in width in the scanning direction.

When a toner image forming unit 4 is capable of optically adjusting the scanning width on the photoconductor drum 3 by adjusting the optical system from the polygon mirror to the photoconductor drum 3, it is possible that a magnification ratio $M_{KC}$ is calculated by the following equation (3). The optical system is adjusted according to this magnification ratio.

$$M_{KC} = \frac{D_{KCR} - D_{KCL} + L}{L} \tag{3}$$

In this equation, L denotes a length between the left and right detection sensors 120. Even if the optical system is not adjustable, if the dot width is variable, the dot width may be reduced according to the magnification ratio $M_{KC}$. In the processing of S4, by performing these corrections, it becomes possible to form a satisfactory image without color shift. Substantially, processing of the dot thinning-out and the like are not executed at S4 at the time of initialization, but are executed when image data are inputted from a PC or the like into the input interface 135, and parameters necessary for this processing is stored in the RAM 15 at S4.

Figure 11A:
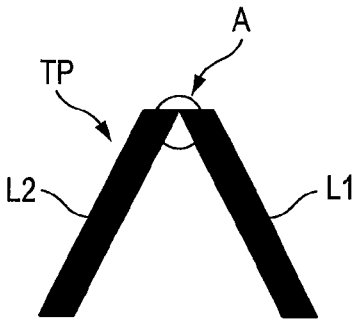
FIGS. 11A through 11D are explanatory views showing details of the test pattern according to the processing.
Figure 11B:
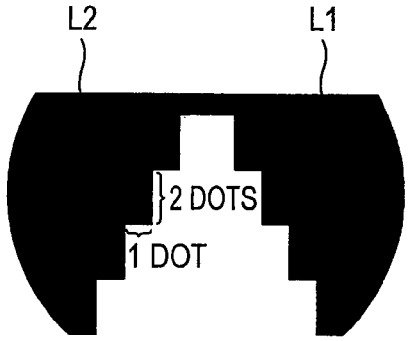
Figure 11C:
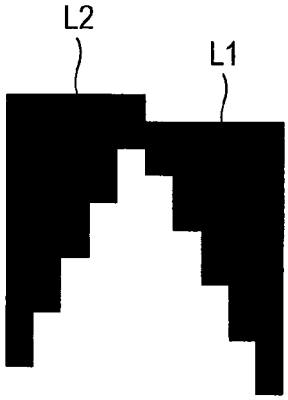

Next, a detailed configuration of the test pattern TP will be considered. As shown in FIG. 11B as an enlarged view of the portion A of FIG. 11A, when the pair of line segments L1 and L2 constituting the test pattern TP are formed into step-like shapes which extend by two dots in the scanning direction while extending by one dot symmetrically toward directions different from each other along the sub-scanning direction, the deviation is calculated only in units of two dots. Therefore, as shown in FIG. 11C, it is considered that the line segments L1 and L2 are formed into step-like shapes which extend by two dots in the scanning direction while extending by one dot toward different directions along the sub-scanning direction, and the positions where the line segments L1 and L2 extend in the sub-scanning direction are respectively shifted by one dot from each other in the scanning direction. In this case, the deviation can be detected in units of one dot.

Figure 11D:
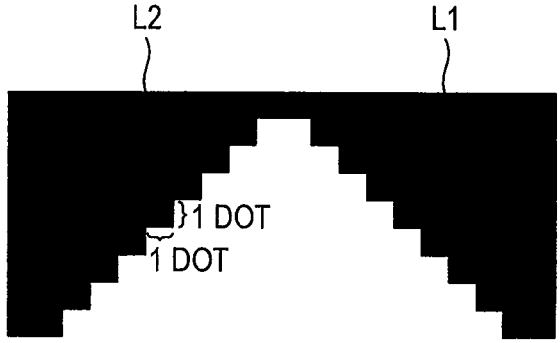

As shown in FIG. 11D, even when the line segments L1 and L2 are formed into step-like shapes which extend by one dot in the scanning direction and also extend by one dot symmetrically in the sub-scanning direction, the deviation can be detected in units of one dot. However, in this case, slanting in the sub-scanning direction of the line segments L1 and L2 becomes greater. In this case, it becomes difficult to detect passage of the line segments L1 and L2 by the detection sensor 120 or it has to be formed that test pattern TP large in the sub-scanning direction (shape collapsed in the sub-scanning direction). On the other hand, by employing the form of FIG. 11C, a deviation can be calculated in units of one dot without greatly increasing the slanting of the line segments L1 and L2 while preventing the above-described problems.

[Effect and Variation of the Aspects]

As described above, the test pattern TP which is formed at the time of initialization includes, as shown in FIG. 8C, a pair of line segments L1 and L2 slanting at same angles toward opposite directions across a straight line orthogonal to the moving direction of the sheet conveying belt 6. In other words, the line segments are offset from the straight line at same angles. Therefore, as illustrated in FIG. 8D, the sensor output change when detecting the line segment L1 and the sensor output change when detecting the line segment L2 become equal to each other, and a threshold Sh can be set to a wide range as shown by the arrow in FIG. 8D. As described above, SS indicates a spot diameter of the detection sensor 120. Therefore, the pair of line segments L1 and L2 can be stably detected without providing a lens and a slit in the detection sensors 120. The pair of line segments L1 and L2 slant toward directions opposite to each other from the sub-scanning direction so that the peak interval $T_K$ or the like (see FIG. 9) can be satisfactorily calculated.

In the above-described aspects, the processing of the toner image forming unit 4 and S1 correspond to the test pattern forming unit, the processing of S3 corresponds to the processing unit, and the processing of S4 corresponds to the correcting unit. The present invention is not limited to the above-described aspect, and can be carried out variously in a range without deviating from the spirit of the present invention. For example, the test patterns TP may be formed on the sheet P and read by the detection sensor 120. In a type of image forming apparatus in which an image is temporarily formed on an intermediate transfer belt and then transferred onto the sheet P, the test patterns TP may be formed on the intermediate transfer belt. In this case, the intermediate transfer belt corresponds to the transferred medium.

It is also possible that deviations $D_{KCR}$, $D_{KCL}$, $D_{CMR}$, $D_{CML}$, $D_{MYR}$, and $D_{MYL}$ calculated through the above-described processing are transmitted to a PC, and by correcting data by a printer driver on the PC side, color shift is prevented. In this case, on the printer side, the correcting unit becomes unnecessary. Furthermore, in the above-described aspect, deviations between adjacent test patterns of black, cyan, magenta, and yellow are calculated, however, it is also possible that a specific test pattern TP of black or the like is used as a reference and deviations of other color test patterns TP are calculated. However, when the processing of the above-described aspect is applied, accumulative influence from a speed change of the like of the sheet conveying belt 6 can be eliminated. Furthermore, it is not always necessary that the line segments L1 and L2 slant at the same angle, and if these slant toward opposite directions across a straight line of the sub-scanning direction, a slight difference in angle between these is allowed.

Figure 12A:
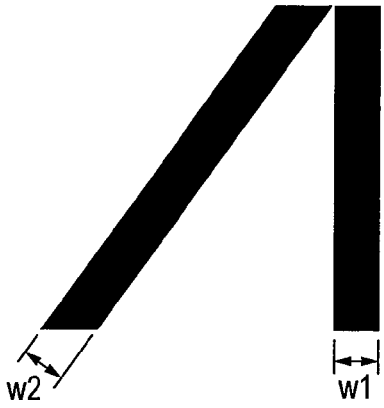
FIGS. 12A and 12B are explanatory views showing test patterns according to other aspects.

The line segments L1 and L2 may have same widths w1 and w2 as shown in FIG. 12A. In this case, the sensor output change when detecting the line segment L1 and the sensor output change when detecting the line segments L2 become substantially equal to each other.

Figure 12B:
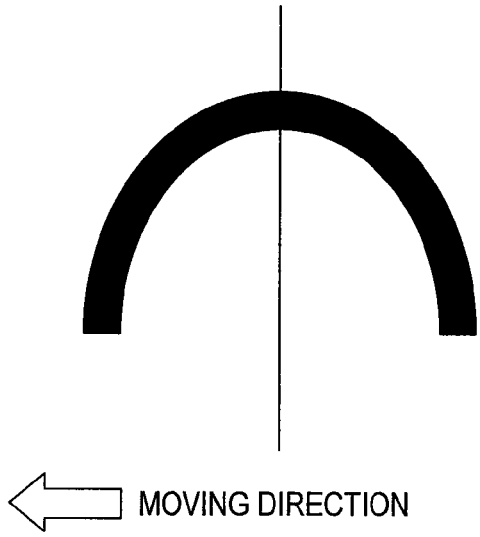

The line segments L1 and L2 include curved sections which are symmetric about a line along the main scanning direction as shown in FIG. 12B. In this case also, the sensor output change when detecting the line segment L1 and the sensor output change when detecting the line segments L2 become substantially equal to each other.

Figure 13A:
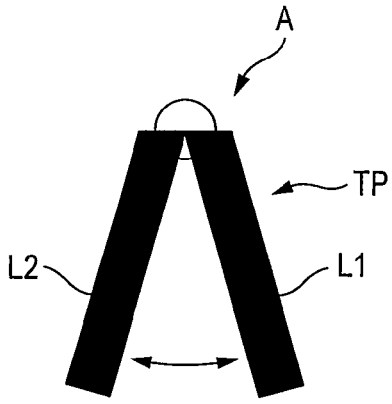
FIGS. 13A through 13C are explanatory views showing test patterns according to other aspects.
Figure 13B:
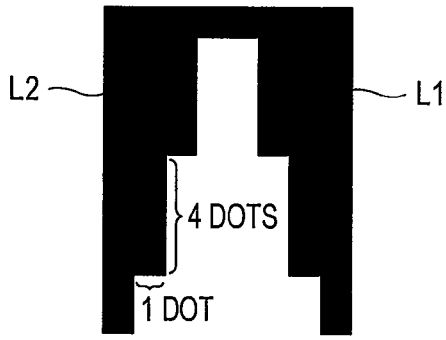
Figure 13C:
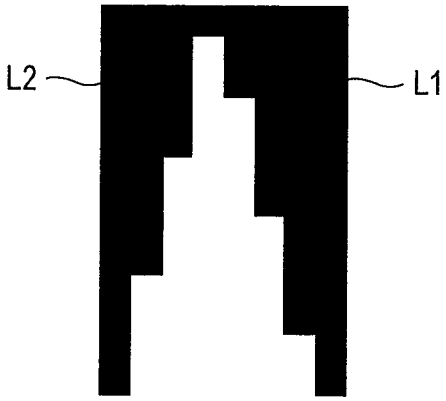

The line segments L1 and L2 constituting the test pattern TP may be configured as shown in FIGS. 13A to 13C. In this test pattern TP, each of the line segments L1 and L2 is offset by smaller angle compared with that shown in FIGS. 11A to 11C in which the line segments L1 and L2 are formed into step-like shapes which extend by two dots in the scanning direction while extending by one dot along sub-scanning direction. FIG. 13B is an enlarged view of the portion A of FIG. 13A. As shown in FIG. 13B, for example, the line segments L1 and L2 are formed into step-like shapes which extend by four dots in the scanning direction while extending by one dot symmetrically toward directions different from each other along the sub-scanning direction. In this case, the deviation can be detected in units of four dots.

In addition, the line segments L1 and L2 shown in FIG. 13C are formed into step-like shapes which extend by four dots in the scanning direction while extending by one dot toward different directions along the sub-scanning direction, and the positions where the line segments L1 and L2 extend in the sub-scanning direction are respectively shifted by two dots from each other in the scanning direction. In this case, the deviation can be detected in units of two dots.

According to the test pattern TP as shown in FIGS. 13A to 13C, since the line segments L1 and L2 are offset by smaller angle, the dimension of the test pattern TP in the sub-scanning direction becomes smaller. Therefore, a necessary moving amount of the sheet conveying belt 6 on which the test pattern TP is formed for reading the test pattern TP becomes smaller. And, a necessary time for reading the test pattern TP becomes shorter.

The present invention provides illustrative, non-limiting embodiments as follows:

An image forming apparatus includes: a conveying unit that conveys a transferred medium in a first direction; an image forming unit that forms an image on the transferred medium conveyed by the conveying unit; a controller that controls the image forming unit to form a test pattern on either one of the conveying unit and the transferred medium, the test pattern including first and second line segments slanting toward directions opposite to each other, wherein the first line segment is offset, in an offset direction, from a second direction orthogonal to the first direction and the second line segment is offset, in a direction opposite to the offset direction, from the second direction; a detection unit that is disposed downstream from the image forming unit in the first direction and detects passage of at least respective parts of the first and second line segments; and a calculating unit that calculates a position where the image forming unit forms an image based on a time difference between times at which the detection unit detects the passage of the at least respective parts of the first and second line segments.

The transferred medium may be conveyed together with a moving of the conveying unit.

The image forming apparatus may further include a correcting unit that corrects a position of an image to be formed by the image forming unit based on the position calculated by the calculating unit.

The first and second line segments may be offset from the second direction at equal angles.

The first and second line segments may be formed into step-like shapes, the first line segment extending by two dots in the second direction while extending by one dot in the first direction, and the second line segment extending by two dots in the second direction while extending by one dot in a direction opposite to the first direction. Positions where the first and second line segments extend in the second direction may be respectively shifted by one dot from each other in the second direction.

The calculating unit may calculate a position where the image forming unit forms the image in the second direction.

The controller may control the image forming unit to form a plurality of the test patterns. The calculating unit may calculate the position where the image forming unit forms the image based on an average of the time differences between times at which the detection unit detects the passage of the at least respective parts of the first and second line segments of the plurality of the test patterns.

A test pattern used for an image forming apparatus includes a conveying unit that conveys a transferred medium in a first direction and an image forming unit that forms an image on the transferred medium, the test pattern configured to be formed on either one of the conveying unit and the transferred medium by the image forming unit, the test pattern includes: first and second line segments slanting toward directions opposite to each other, wherein the first line segment is offset, in an offset direction, from a second direction orthogonal to the first direction and the second line segment is offset, in a direction opposite to the offset direction, from the second direction.

The first and second line segments may be offset from the second direction at equal angles.

The first and second line segments may be formed into step-like shapes, the first line segment extending by two dots in the second direction while extending by one dot in the first direction, and the second line segment extending by two dots in the second direction while extending by one dot in a direction opposite to the first direction. Positions where the first and second line segments extend in the second direction may be respectively shifted by one dot from each other in the second direction.

An image forming apparatus includes: a conveying unit that conveys a transferred medium in a first direction; a plurality of image forming units that form images on the transferred medium; a controller that controls the image forming units to form a plurality of test patterns on either one of the transferred medium and the conveying unit, each test pattern including first and second line segments slanting toward directions opposite to each other, wherein the first line segment is offset, in an offset direction, from a second direction orthogonal to the first direction and the second line segment is offset, in a direction opposite to the offset direction, from the second direction; a detection unit that detects passage of at least respective parts of the first and the second line segments; a calculating unit that calculates a relative position of an image to be formed by each of the image forming units in the second direction based on time differences between times at which the detection unit detects the at least respective parts of the first and second lines formed by respective image forming units.

The plurality test patterns may have a substantially same shape.

The calculating unit may calculate the relative position of the image to be formed by each of the image forming units based on a difference between the time differences in respective image forming units.

The image forming apparatus may further include a correcting unit that corrects relative positions of images to be formed by the image forming units based on the relative position calculated by the calculating unit.

What is claimed is:

1. An image forming apparatus comprising:

a conveying unit that conveys a transferred medium in a first direction;

an image forming unit that forms an image on the transferred medium conveyed by the conveying unit;

a controller that controls the image forming unit to form a test pattern on either one of the conveying unit and the transferred medium, the test pattern including first and second line segments slanting toward directions opposite to each other, wherein the first line segment is offset, in an offset direction, from a second direction orthogonal to the first direction and the second line segment is offset, in a direction opposite to the offset direction, from the second direction, the first and second line segments being offset from the second direction at equal angles;

a detection unit that is disposed downstream from the image forming unit in the first direction and detects passage of at least respective parts of the first and second line segments; and a calculating unit that calculates a position where the image forming unit forms an image based on a time difference between times at which the detection unit detects the passage of the at least respective parts of the first and second line segments, wherein the first and second line segments are formed into step-like shapes, the first line segment extending by a plurality of dots in the second direction while extending by one dot in the first direction, and the second line segment extending by a plurality of dots in the second direction while extending by one dot in a direction opposite to the first direction, and wherein positions where the first and second line segments extend in the second direction are respectively shifted from each other in the second direction.

2. The image forming apparatus according to claim 1, wherein the transferred medium is conveyed together with a moving of the conveying unit.

3. The image forming apparatus according to claim 1 , further comprising a correcting unit that corrects a position of an image to be formed by the image forming unit based on the position calculated by the calculating unit.

4. The image forming apparatus according to claim 1, wherein the first line segment extends by two dots in the second direction while extending by one dot in the first direction, and the second line segment extends by two dots in the second direction while extending by one dot in the direction opposite to the first direction, and wherein positions where the first and second line segments extend in the second direction are respectively shifted by one dot from each other in the second direction.

5. The image forming apparatus according to claim 1, wherein the calculating unit calculates a position where the image forming unit forms the image in the second direction.

6. The image forming apparatus according to claim 1, wherein the controller controls the image forming unit to form a plurality of the test patterns, and wherein the calculating unit calculates the position where the image forming unit forms the image based on an average of the time differences between times at which the detection unit detects the passage of the at least respective parts of the first and second line segments of the plurality of the test patterns.

7. The image forming apparatus according to claim 1, wherein the first line segment extends by four dots in the second direction while extending by one dot in the first direction, and the second line segment extends by four dots in the second direction while extending by one dot in a direction opposite to the first direction, and wherein positions where the first and second line segments extend in the second direction are respectively shifted by two dots from each other in the second direction.

8. An image forming apparatus comprising:

a conveying unit that conveys a transferred medium in a first direction;

a plurality of image forming units that form images on the transferred medium;

a controller that controls the image forming units to form a plurality of test patterns on either one of the transferred medium and the conveying unit, each test pattern including first and second line segments slanting toward directions opposite to each other, wherein the first line segment is offset, in an offset direction, from a second direction orthogonal to the first direction and the second line segment is offset, in a direction opposite to the offset direction, from the second direction, the first and second line segments being offset from the second direction at equal angles;

a detection unit that detects passage of at least respective parts of the first and the second line segments;

a calculating unit that calculates a relative position of an image to be formed by each of the image forming units in the second direction based on time differences between times at which the detection unit detects the at least respective parts of the first and second lines formed by respective image forming units, wherein the first and second line segments are formed into step-like shapes, the first line segment extending by a plurality of dots in the second direction while extending by one dot in the first direction, and the second line segment extending by the plurality of dots in the second direction while extending by one lot in direction opposite to the first direction, and wherein positions where the first and second line segments extend in the second direction are respectively shifted from each other in the second direction.

9. The image forming apparatus according to claim 8, wherein the plurality of test patterns have substantially the same shape.

10. The image forming apparatus according to claim 8, wherein the calculating unit calculates the relative position of the image to be formed by each of the image forming units based on a difference between the time differences in respective image forming units.

11. The image forming apparatus according to claim 8, further comprising a correcting unit that corrects relative positions of images to be formed by the image forming units based on the relative position calculated by the calculating unit.

12. The image forming apparatus according to claim 8, wherein the first line segment extends by four dots in the second direction while extending by one dot in the first direction, and the second line segment extends by four dots in the second direction while extending by one dot in a direction opposite to the first direction, and wherein positions where the first and second line segments extend in the second direction are respectively shifted by two dots from each other in the second direction.

13. An image forming apparatus comprising:

a conveying unit that conveys a transferred medium in a first direction;

an image forming unit that forms an image on the transferred medium conveyed by the conveying unit;

a controller that controls the image forming unit to form a test pattern on either one of the conveying unit and the transferred medium, the test pattern including first and second line segments which have the same widths;

a detection unit that is disposed downstream from the image forming unit in the first direction and detects passage of at least respective parts of the first and second line segments; and a calculating unit that calculates a position where the image forming unit forms an image based on a time difference between times at which the detection unit detects the passage of the at least respective parts of the first and second line segments, wherein the first and second line segments are formed into step-like shapes, the first line segment extending by a plurality of dots in a second direction orthogonal to the first direction while extending by one dot in the first direction, and the second line segment extending by the direction while extending b one dot in a direction opposite to the first direction, and wherein positions where the first and second line segments extend in the second direction are respectively shifted from each other in the second direction.

14. The image forming apparatus according to claim 13, wherein the first line segment extends by four dots in the second direction while extending by one dot in the first direction, and the second line segment extends by four dots in the second direction while extending by one dot in a direction opposite to the first direction, and wherein positions where the first and second line segments extend in the second direction are respectively shifted by two dots from each other in the second direction.

* * * * *

UNITED STATES PATENT AND TRADEMARK OFFICE

CERTIFICATE OF CORRECTION

PATENT NO. : 7,660,552 B2
APPLICATION NO. : 11/780785
DATED : February 9, 2010
INVENTOR(S) : Kazuhiro Yamagata It is certified that error appears in the above-identified patent and that said Letters Patent is hereby corrected as shown below:

In Column 14, Claim 8, Line 20:
Please replace "extending by one lot in direction" with --extending by one dot in a direction--

In Column 15, Claim 13, Lines 5-6:
Please replace "extending by the direction while extending b one dot" with --extending by the plurality of dots in the second direction while extending by one dot--

Signed and Sealed this

Fifteenth Day of June, 2010

David J. Kappos

David J. Kappos
*Director of the United States Patent and Trademark Office*